United States Patent [19]

O'Shea et al.

[11] Patent Number: 4,994,945

[45] Date of Patent: Feb. 19, 1991

[54] LAMP SYSTEM FOR OPERATING THEATRES AND THE LIKE

[75] Inventors: Donald C. O'Shea, Atlanta, Ga.; James L. Oliver, Asheville, N.C.; James L. Sketo, Stockbridge, Ga.

[73] Assignee: Kirschner Medical Corporation, Timonium, Md.

[21] Appl. No.: 456,102

[22] Filed: Dec. 22, 1989

Related U.S. Application Data

[63] Continuation-in-part of Ser. No. 302,566, Jan. 26, 1989, Pat. No. 4,937,715.

[51] Int. Cl.[5] ..... F21V 13/00

[52] U.S. Cl. ..... 362/268; 362/226; 362/293; 362/294; 362/804

[58] Field of Search ..... 362/226, 268, 293, 294, 362/308, 309, 310, 329, 332, 337, 804

[56] References Cited

U.S. PATENT DOCUMENTS

| | | | |
|---|---|---|---|
| 2,827,554 | 3/1958 | Gunther et al. | 362/33 |
| 3,225,184 | 12/1965 | Reiber | 362/33 |
| 3,360,640 | 12/1967 | Seitz et al. | 362/12 |
| 3,732,417 | 5/1973 | Nordquist | 362/309 |
| 3,941,993 | 3/1976 | Hubert | 362/309 |
| 4,135,231 | 1/1979 | Fisher | 362/269 |
| 4,153,929 | 5/1979 | Laudenschlarger et al. | 362/348 |
| 4,159,511 | 6/1979 | Dejond | 362/804 X |

*Primary Examiner*—Stephen F. Husar
*Attorney, Agent, or Firm*—Frost & Jacobs

[57] ABSTRACT

A lamp for providing uniform luminosity in an area to be illuminated, such as in an operating theatre and the like. The lamp comprises a light source, an infrared filter element, a planar prism field, having a substantial number of radial sectors containing a plurality of transverse, outwardly curved prisms, and a toroidal lens system which controls the divergence of the light emanating from the light source so as to render the light substantially columnate and to direct the light onto the planar prism field, a transparent member beneath the planar prism field to protect the planar prism field from dirt, foreign material and scratches, and a handle extending downwardly from the face of the lamp by which the lamp can be manipulated. The radial sectors are held together in the planar prism field by attachment to one another. As a result, the transparent member can be thin since it is not required to support the planar prism field. The transparent member, therefor, can be removed for cleaning or replacement without disassembly of the planar prism field. The lens of the toroidal lens system is a conical Fresnel lens.

7 Claims, 9 Drawing Sheets

PRIOR ART 11
24
23
22
21
25
16
55

| NO. | ANGLE | RADIUS | R TOL. |
|---|---|---|---|
| 1 | 65° 10' | 10.5 | ±.25 |
| 2 | 66° 10' | 12 | |
| 3 | 66° 35' | 13 | |
| 4 | 67° 25' | 15 | |
| 5 | 67° 00' | 17 | |
| 6 | 66° 50' | 18 | |
| 7 | 66° 10' | 20 | |
| 8 | 65° 30' | 22 | |
| 9 | 64° 30' | 25 | |
| 10 | 63° 30' | 27 | ±.50 |
| 11 | 62° 30' | 29 | |
| 12 | 61° 50' | 32 | |
| 13 | 60° 35' | 35 | |
| 14 | 59° 50' | 37 | |
| 15 | 58° 30' | 40 | |
| 16 | 57° 50' | 42 | |
| 17 | 57° 00' | 45 | |
| 18 | 56° 00' | 47 | |
| 19 | 55° 50' | 49 | |
| 20 | 55° 00' | 51 | |
| 21 | 54° 50' | 53 | |
| 22 | 54° 10' | 56 | |
| 23 | 54° 00' | 58 | |
| 24 | 53° 10' | 61 | |
| 25 | 53° 00' | 59 | |

LAMP SYSTEM FOR OPERATING THEATRES AND THE LIKE

REFERENCE TO RELATED APPLICATION

This is a continuation-in-part of copending application Ser. No. 07/302,566, filed Jan. 26, 1989 in the name of the same inventors and entitled IMPROVED LAMP SYSTEM- FOR OPERATING THEATRES AND THE LIKE, now U.S. Pat. No. 4,937,715.

BACKGROUND OF THE INVENTION

Several lamps have been developed in an attempt to provide uniform illumination of a relatively large work area such as that found in an operating theatre environment. Examples of such lamps are disclosed in U.S. Pat. Nos. 4,159,511 to Dejonc (using concave reflecting surface), 4,153,929 to Laudenschlarger (using multifaceted reflector), 4,135,231 to Fisher (using coaxially-arranged, curved reflectors with a single movable light source), 3,732,417 to Nordquist (using a conventional circular reflector and prismatic lens system), 3,360,640 to Seitz et al. (using multiple, individual light sources from individual fiberglass light-conducting bundle), 3,225,184 to Reiber (using several individual light fixtures directed onto a field), 2,827,554 to Gunther et al. (using several individual light fixtures directed on a field), and 2,495,320 to Franck (using a plurality of individual light sources, each having a horizontal square 2-component refractor). All of the above references are hereby incorporated into the present disclosure by reference. Lamps of the above types have been unsatisfactory because they have failed to provide both a desired degree of uniform luminosity together with a sufficient depth of field such that the light source may be conveniently moved about the task surface without adversely affecting the luminosity characteristics.

The present invention represents an improvement in a type of lamp different from the above-referenced systems An early lamp of this type was described by Blin in French Patent No. 1,495,007. The Blin reference teaches a lamp whose light source resides above a field of concentrically circular prisms. The light emanating from the light source passes through a toroidal lens (such as a Fresnel-type lens) which renders the beam substantially columnar and directs the columnar beam onto the prism field where the columnar beams are redirected (by internal reflection) and concentrated (by action of the prism curvature) onto a target field below the prism plane.

More recently, U.S. Pat. No. 3,941,993 to Hubert improved upon the Blin lamp by the use of straight prisms across radial sectors of the planar prism field so as to produce a prism field resembling a spider web design. Such construction provided columnar light beams emanating from a toroidal lens system so as to impinge upon straight prisms which maintain the columnarity of the light beams and by reflection overlap them from all radial sectors of the prism field into the illuminated target field. The result was an illuminated target field of greater width without the greatly intensified illumination ("hot spots") which resulted from the concentrically, inwardly curved prisms of Blin.

One of the remaining problems associated with the lamp proposed by Hubert is that its resultant, intersecting, columnar light beams provide only a narrow depth of field with uniform luminosity. The region of best illumination in such a lamp occurs over a working distance (i.e., distance from the lamp to the target field) which is quite small, and which is achieved at a point where all of the patches of light from each prism sector overlap. This effect is illustrated by the luminosity curves shown in FIG. 1A. The luminosity curve of the Hubert lamp is represented by the broken lines in FIG. 1A while the luminosity curve of the present invention is represented by solid lines. FIG. 1A shows that a lamp in accordance with the Hubert reference achieves uniform luminosity (seen as a plateau in the luminosity curve) at distances from about 40 inches to about 54 inches from the prism plane. At distances greater than 54 inches from the prism plane, it can be seen in FIG. 1A that the luminosity curve of the Hubert lamp becomes depressed in the center of the field as the intersecting columnar beams begin to diverge from their point of intersection. In practice, this effect manifests itself as a doughnut-shaped illumination with a dark center.

It has heretofore not been recognized that the depth of field can be improved by controlling the divergence, in the angular direction, of the light leaving each of the individual prisms from a given radial sector.

It is therefore desirable to produce a lamp which achieves both uniform luminosity (i.e., through the intersection of non-focused light beams) and which provides a much greater depth of field and makes such uniform illumination available to the user over a much greater range of distances between the lamp and the object or surface to be illuminated. Uniform luminosity is particularly critical in an operating theatre environment because the task surface is generally three-dimensional and particularly prone to shadowing. Providing uniform light from a number of radial sectors helps eliminate such shadowing. Greater depth of field is also important due to the desirability of having the lamp movable so as to illuminate from varying distances. This allow clearance for equipment and members of the surgical team.

It has also been the practice in the past to support such fields of prisms upon a transparent plate. A disadvantage of such an arrangement is that if such a plate becomes soiled or scratched, it must be cleaned and/or replaced. Removal of the plate for either purpose causes all of the prisms to be displaced from their normal positions in the lamp.

Therefore, it is desirable to produce a lamp of the above-described type whose prism sectors are both self-supporting and protected from soil or damage from the lamp's outside environment.

According to the present invention it has been found advantageous to provide the toroidal lens system with a conical Fresnel lens made of plastic. Furthermore, the infrared filter is preferably made in two parts: a lower part treated to filter infrared rays and an upper non-filtering part so that none of the rays pass through the filtering part more than once. The protective transparent plate beneath the planar circular prism field is removable for cleaning or replacement without disturbing the prism field. The lamp handle, which depends from the lamp and is centered with respect to the prism field is vented to allow air to circulate about the light source to cool the light source. The light source itself, is mounted on a light source holding assembly. The light source holding assembly is preferably disposable and is replaced when the light source is replaced.

SUMMARY OF THE INVENTION

The foregoing objects and advantages are achieved in the present invention which is a lamp for providing luminosity for use in an operating theatre and the like. In its most general form, the invention comprises: (a) a light source, (b) a planar field comprising radial sectors containing a plurality of outwardly curved prisms, and (c) a toroidal lens system, including a plastic conical Fresnel lens, which controls the divergence of the light emanating from the light source so as to render it substantially columnated and directs the light onto the planar field. The curvature of the transverse, outwardly curved prisms varies such that the curvature of the prisms toward the center of the field is greater than those toward the outside of the field. It is preferred that the curvature of each prism in the sequence from the inside of a given sector to the outside of a given sector is less than the curvature of a prism preceding it in the sequence of prisms from the inside of the sector to the outside of the sector. It is further preferred that the curvature of each prism in the sequence from the inside of the sector to the outside of the sector is less than the prism immediately preceding it in said sequence. It is most preferred that the curvature of the prisms be determined according to ray trace equations.

The radial sectors of the lamp of the present invention may be constructed in any manner so as to achieve their intended purpose. One such method is to provide each sector with alternating tongue and groove structures so that the entire prism assembly may be attached so as to form an integral planar prism field.

By integrally attaching the radial sectors, it is possible to construct the lamp of the present invention so as to feature an additional transparent plate or film between the prism field and the area to be illuminated. Such plate or film may be removed for cleaning, repair or replacement without the necessity of dislodging the prism sectors from their assembled positions in the prism field.

The lamp is provided with a downwardly depending handle, located centrally of the circular planar prism field. The handle is provided with a plurality of slots whereby air can circulate about the light source to cool the light source.

The light source is mounted on a light source holding assembly which is disposable along with the light source.

An infrared filter is located within the conical Fresnel lens and about the light source. The filter comprises a lower filtering portion and an upper non-filtering portion so that rays from the light source pass through the filtering portion only once.

DESCRIPTION OF THE DRAWINGS

The following drawings, in which like numbers refer to like structure and features, present one embodiment of the present invention.

DETAILED DESCRIPTION OF THE PREFERRED EMBODIMENT

Figure 1:
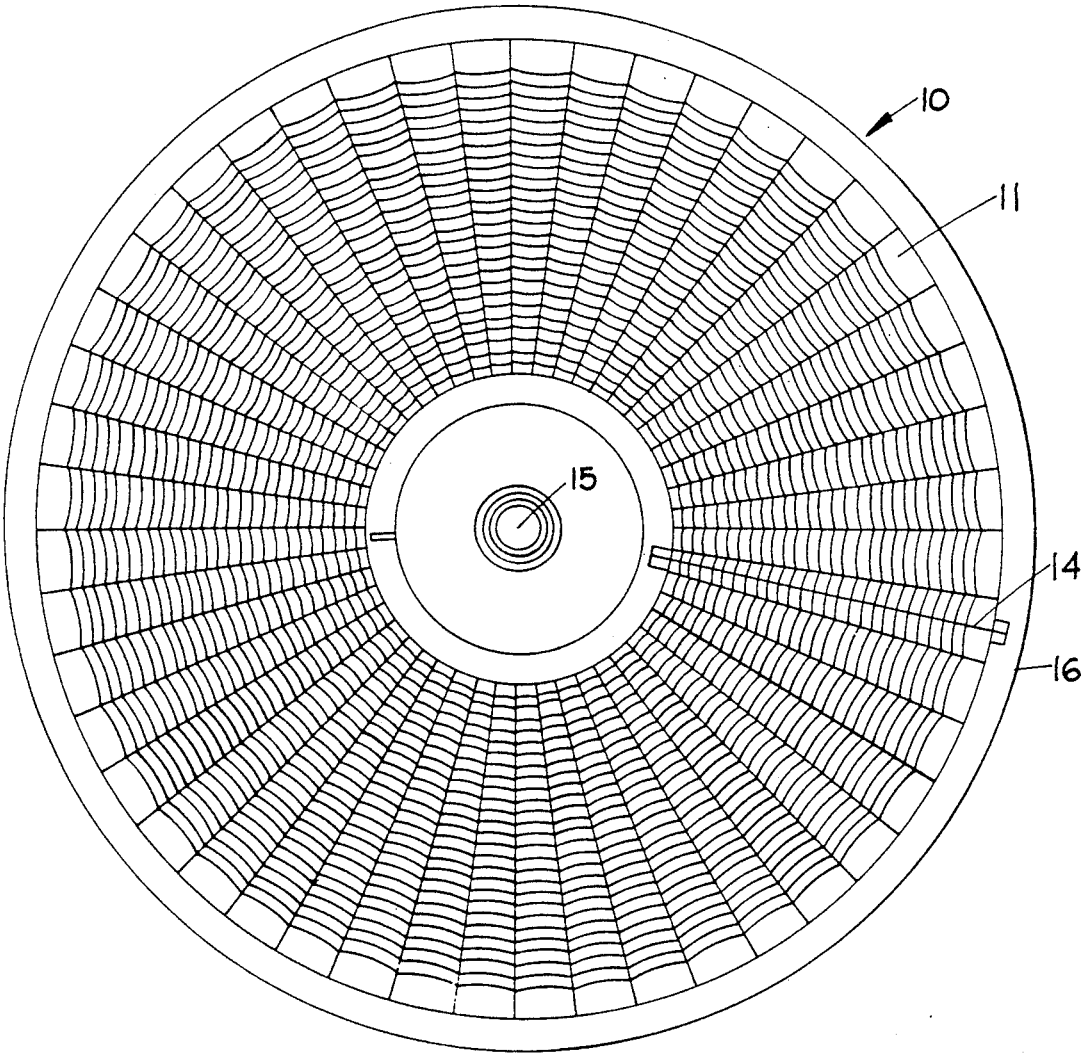
FIG. 1 is a plan view of a planar, circular prism field in accordance with one embodiment of the present invention.

In describing a preferred embodiment of the invention illustrated in the drawings, specific terminology will be resorted to for the sake of clarity. However, the invention is not intended to be limited to the specific terms so selected, and it is understood that a specific term includes all technical equivalents which operate in a similar manner to accomplish a result similar to that of the disclosed invention.

Referring to the drawings, FIG. 1 shows a planar prism field generally indicated at 10 and comprising a plurality of individual radial sectors containing radial prism sectors such as 11. The prism sectors may be constructed of appropriate transparent, optical grade materials such as the glasses or polymers known in the art. An example of such materials include plexiglass, which is preferably molded.

Each radial sector 11 comprises a series of outwardly curved prisms as shown bracketed along longitudinal, radial axis 14. The curvature of the prisms varies such that the curvature of the prisms toward the center of the circular field 15 is relatively greater than those prisms toward the outside of the circular field 16. The curvature of the prisms may also preferably be varied such that, from the innermost prism, the curvature of each subsequent prism in the sequence from the inside of the sector to the outside of the sector is less than a prism preceding it in the sequence.

Figures 2, 3, 4, 5:
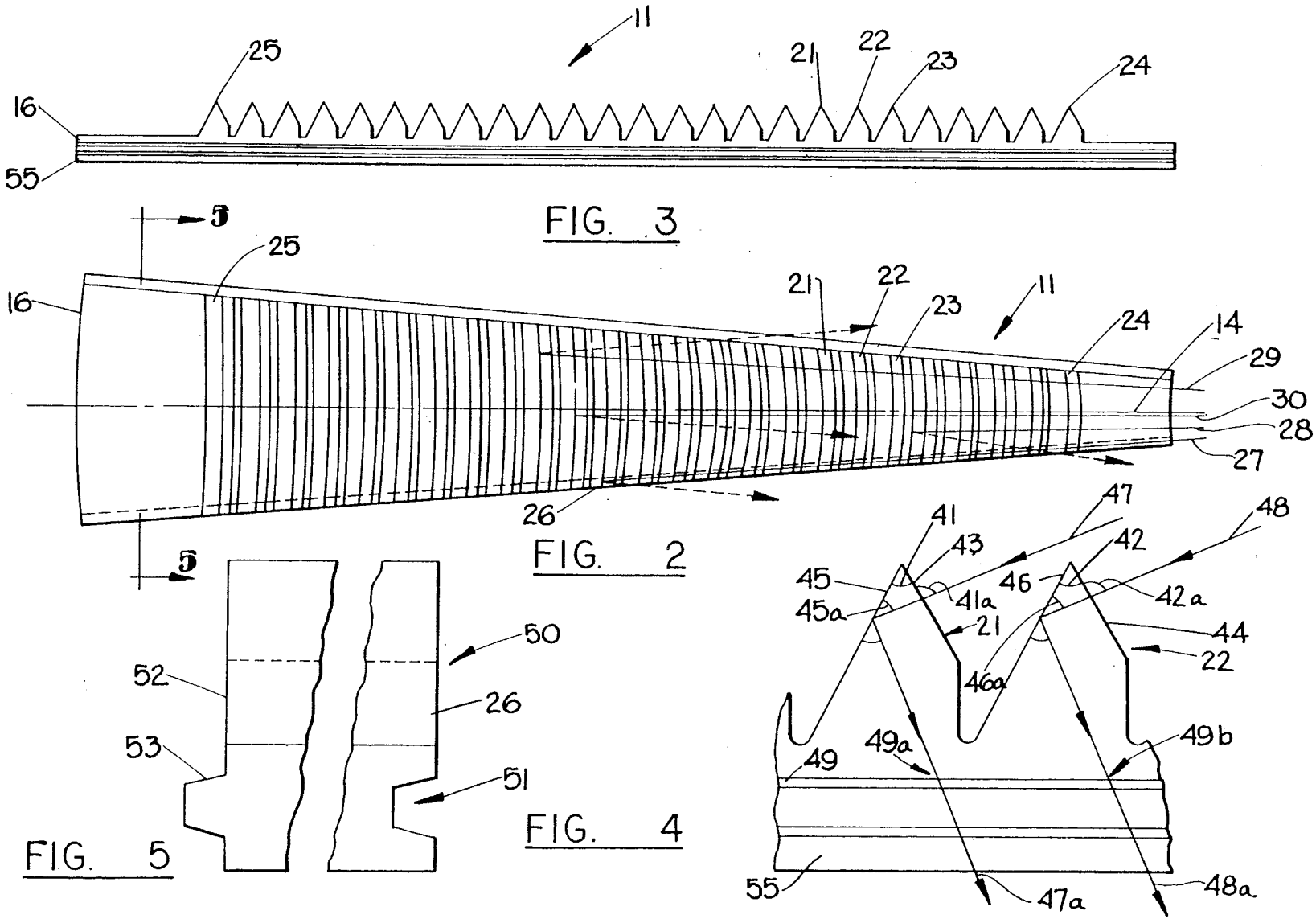
FIG. 2 is a planar view of one radial sector of the planar, circular field shown in FIG. 1.
FIG. 3 is an elevational view of the radial sector shown in FIG. 2.
FIG. 4 is a fragmentary, sectioned, magnified view of two prisms in the radial sector shown in FIG. 3.
FIG. 5 is a fragmentary, cross-sectional view taken along section line 5—5 of FIG. 2.

Such an arrangement of prisms is shown in FIG. 2, which shows radial sector 11 containing a plurality of prisms such as 21, 22 and 23. The aforementioned sequence of prisms begins with innermost prism 24 and proceeds toward the edge of the planar field 16 to outermost prism 25. The prism array can also be seen in elevational view in FIG. 3.

The prisms within a given radial sector are transverse to the radial axis of that sector and their curvature is outward, i.e., concave toward the outside of the planar field. The curvature of the prisms within a given radial sector are generally such that the light emanating from the prisms is diverged in the angular direction. In this embodiment the curvature of the prisms towards the center of the planar field is greater than those toward the outside of the planar field. As indicated above, it is preferred that the curvature of the prisms varies such that, from the innermost prism 24, the curvature of each prism in the sequence from the inside of the radial sector to the outside of the radial sector is less than the curvature of a prism immediately preceding it in said sequence.

As pointed above, the present invention provides control of the divergence, in the angular direction, of light emanating from the prisms of a given radial sector.

Figure 1A:
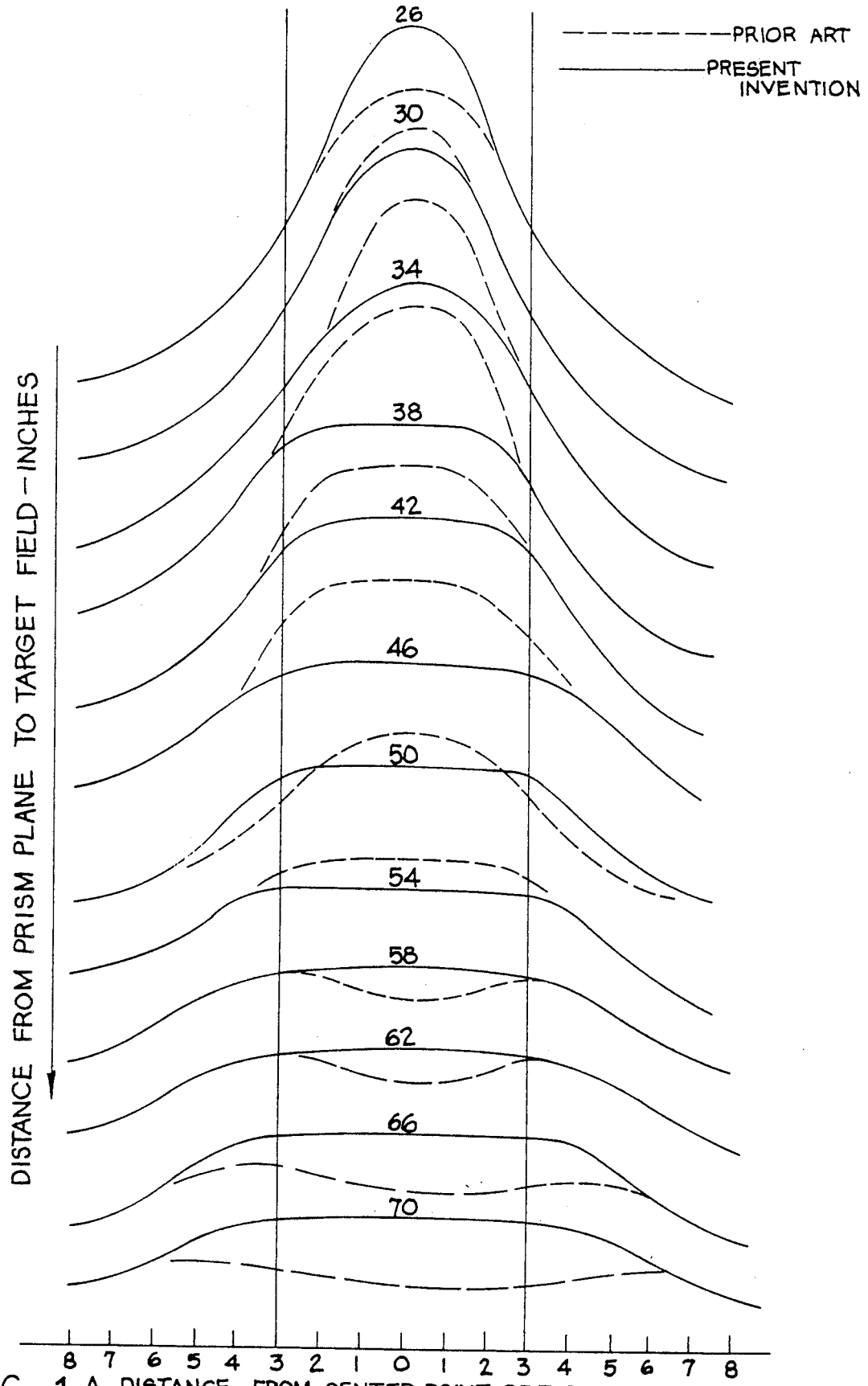
FIG. 1A is a luminosity curve wherein the X axis is the distance below the prism field of two lamps utilizing such prism fields.
Figure 1B:
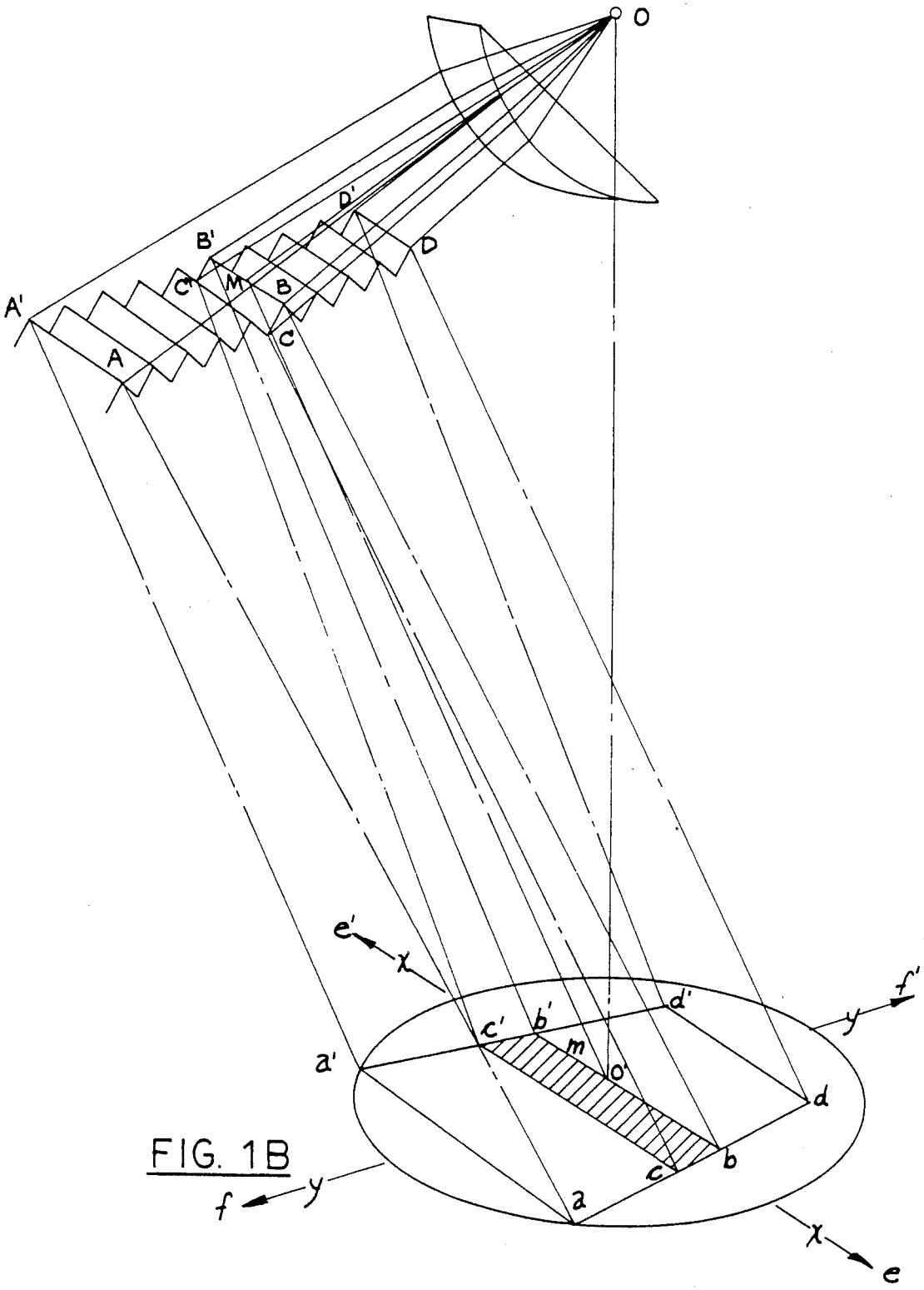
FIG. 1B is a ray trace drawing showing the redirection and distribution of light, toward and into a target plane, by one radial prism sector of the prior art lamp according to Hubert.
Figure 1C:
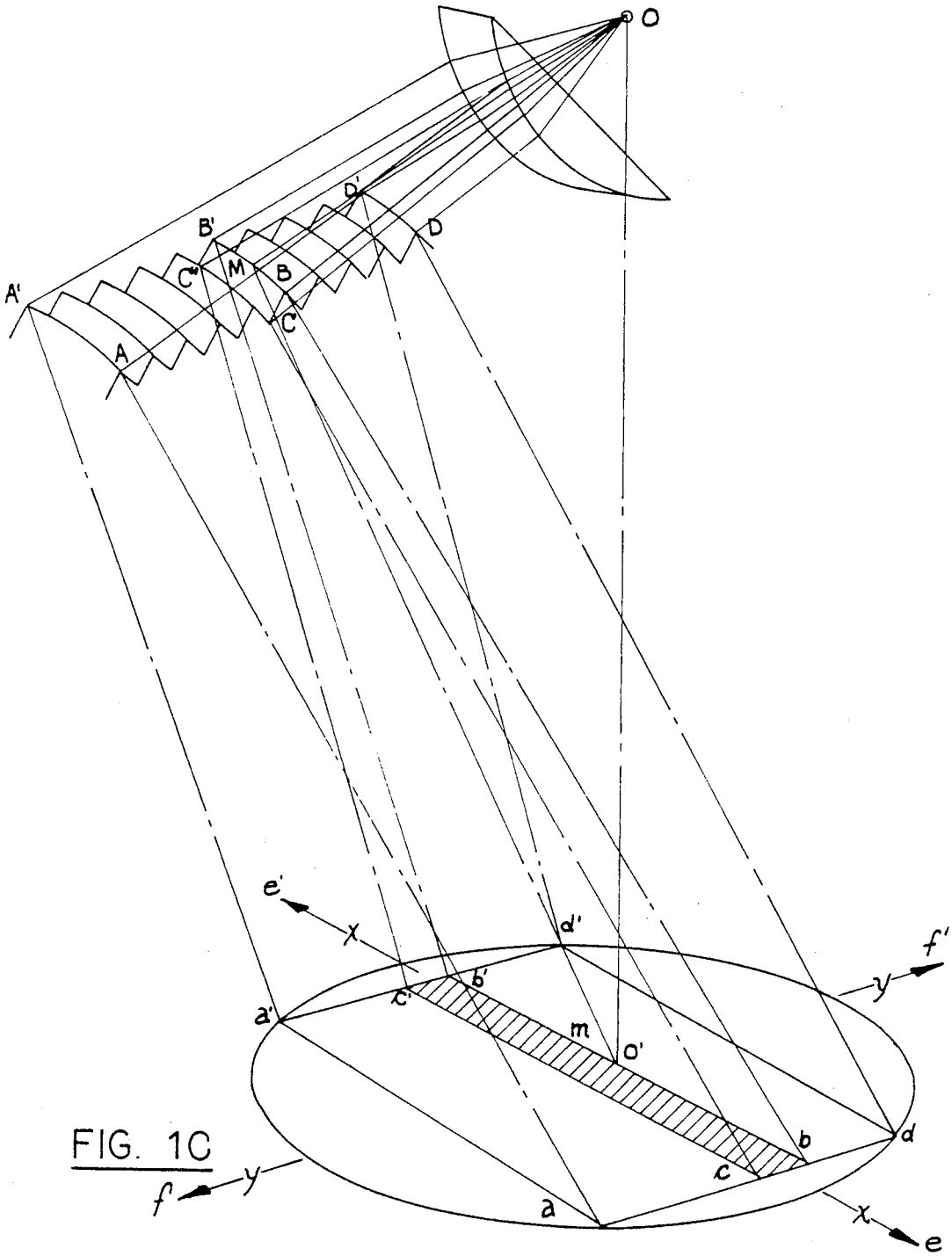
FIG. 1C is a ray trace drawing showing the redirection and distribution of light, toward and into a target plane, by one radial prism sector in accordance with the present invention.

As shown in FIG. 1B, the straight prisms of the prior art (i.e., a lamp according to Hubert), although allowing some natural divergence uniform to all prisms, do not control divergence of the light in the angular direction (i.e., along transverse axis X) Such lack of control renders the resultant patch of light trapezoidal in shape (substantially in accordance with the shape of the radial sector itself; see FIG. 1B). In contrast, FIG. 1C shows the effect of controlling divergence of the light such that lines A'a', B'b', C'c', D'd, diverge in the angular direction e' along axis X in comparison respectively to lines A'a', B'b', C'c', and D'd' shown in FIG. 1B. Likewise, rays Aa, Bb, Cc and Dd diverge in the angular direction e along axis X relative to corresponding rays Aa, Bb, Cc and Dd shown in FIG. 1B. The effect of controlling divergence in the angular direction allows the placement of the edge rays (i.e., A'a', B'b', C'c' and D'd'; and Aa, Bb, Cc and Dd) so as to define the sides (i.e., sides a'd' and ad, respectively) of a laterally broader light patch (i.e., light patch a'd'da). The foregoing effect is brought about by varying the curvature of Prisms within a given radial sector of the planar prism field.

The divergence of light in the radial direction is controlled either by varying the tilt angle of the reflective face of the prisms (such as varying angle 45*a* of reflective surface 45 as shown in FIG. 4) so as to effect divergence of the light in the radial direction; or by varying the angle of the refractive surface (such as angle 41 of refractive surface 43 as shown in FIG. 4) so as to effect divergence of the light in the radial direction by refraction; or by a combination of both. The effect of controlling the radial divergence of the light from each prism allows that patch of light attributed to a given prism to be moved along the radial or meridonal axis (i.e., light patch c'b'bc from prism C'B'BC along axis Y). It is preferred to control the divergence of light in the radial direction by changing the angle of the refractive face because errors in such angle do not multiply themselves to such a great extent as those occurring as a result of errors in the angle of the reflective surface.

FIG. 4 shows a fragmentary, magnified, elevational view of two neighboring prisms 21 and 22 of sector 11 having apex angles 41 and 42, respectively. Prism 21 has refractive surface 43 and reflective surface 45, which together redirect light ray 47 toward the target plane. In like fashion, prism 22 contains refractive surface 44 and reflective surface 46 which cooperate to redirect light ray 48 to the target plane.

FIG. 5 is a fragmentary end view of the radial prism sector 11 of FIG. 2. FIG. 5 illustrates the tongue-and-groove construction by which the individual prism sectors are held together to form a planar prism field.

FIG. 5 shows sectioned radial sector 11 having side 26 containing groove 51 adapted to accept a correspondingly shaped tongue portion contained in the neighboring radial sector adjacent to side 26. Side 52, opposite side 26, contains tongue portion 53 which is adapted to fit into a correspondingly shaped groove in the radial sector adjacent to side 52. The radial sectors may also be held together by a dovetail tongue and groove arrangement. Either such tongue and groove arrangement may be supplemented by the use of appropriate mechanical support means or adhesives.

Figures 6, 8:
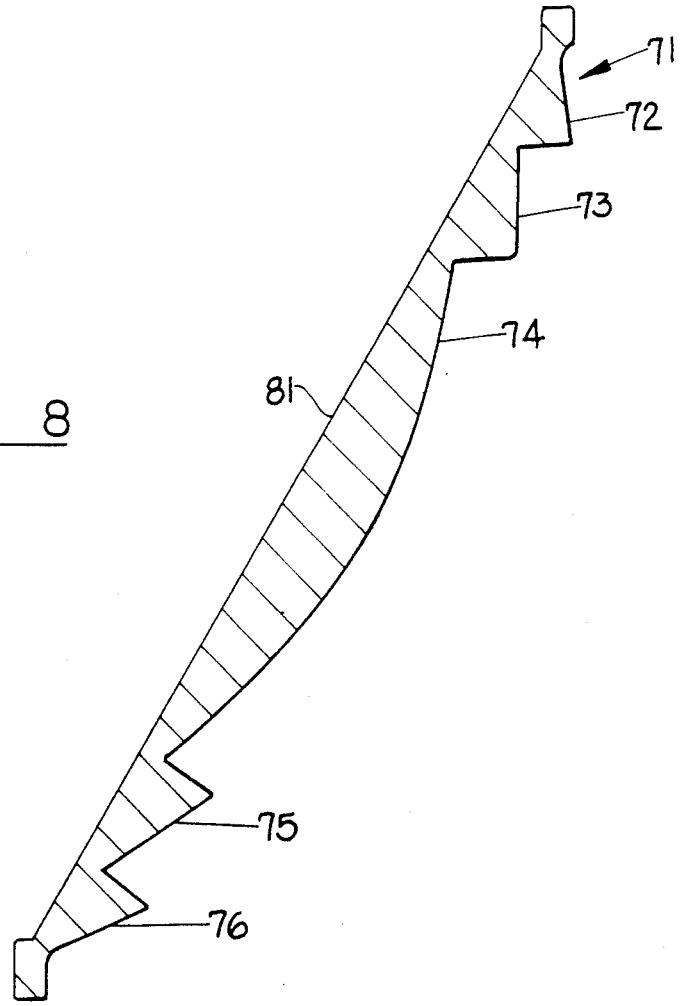
FIG. 6 is a table containing the numbers, apex angles, radii and radii tolerance of a sequence of prisms in a given radial sector of one embodiment of the present invention.
FIG. 8 is a vertical, cross-sectional view of one side of the toroidal lens system shown in FIG. 7.

FIG. 6 is a table containing the apex angles, radii and radii tolerances for a series of 25 prisms; prism number 1 in the table being the innermost prism (such as prism 24 in FIG. 3) and prism number 25 being the outermost prism (such as prism 25 in FIG. 3). The curvature of the prisms is determined by employing a set of ray trace equations. Because each prism curves in a continuous manner, the local surface normal is needed to locate the angle of incidence of a ray before the law of refraction is applied. To do this, the direction cosines of the rays from the lens to the individual prisms were determined along with the direction cosines of the local normal at the point where the rays strike the prisms. Such skew ray trace equations can be found in Herzberger, M., *Modern Geometrical Optics*, Interscience, New York (1958), or in military standardization handbook, *Optical Design*, (MIL - HDBK - 141), Department of Defense, U.S. Government Printing Office (1962), both of which are hereby incorporated herein by reference. Such equations were used to determine the refraction of the ray at the front surface (e.g., 43 and 44) of the curved prisms, the reflection off the inside back surfaces (e.g., 45 and 46), and the refraction of the reflected ray out of the bottom of the prism array (through surface 49, for instance, at points 49*a* and 49*b*). The curvature of each prism is determined individually by setting a value for the prism curvature and sending a ray to one edge of the prism (edge 26), perpendicular to the prism curve, and determining where that ray would hit in the target plane. The rationale behind this method is that finding the location of the ray at the edge of the radial sectors (e.g., ray 27, all other rays, e.g., rays 28 and 29) between the edge rays and the central rays (e.g., ray 30) fall there between. By using a standard "spreadsheet" computer program incorporating the appropriate skew ray trace equations, the effect of changing curvature of a particular prism quickly yields a new value for the ray location in the target plane. For instance, the curvature of each prism may be set so that the edge ray of each prism would be located a given number of inches from the central ray (e.g., ray Mo' in FIG. 1C) and each ray bundle giving an overall patch width of two times said given number of inches.

Figure 7:
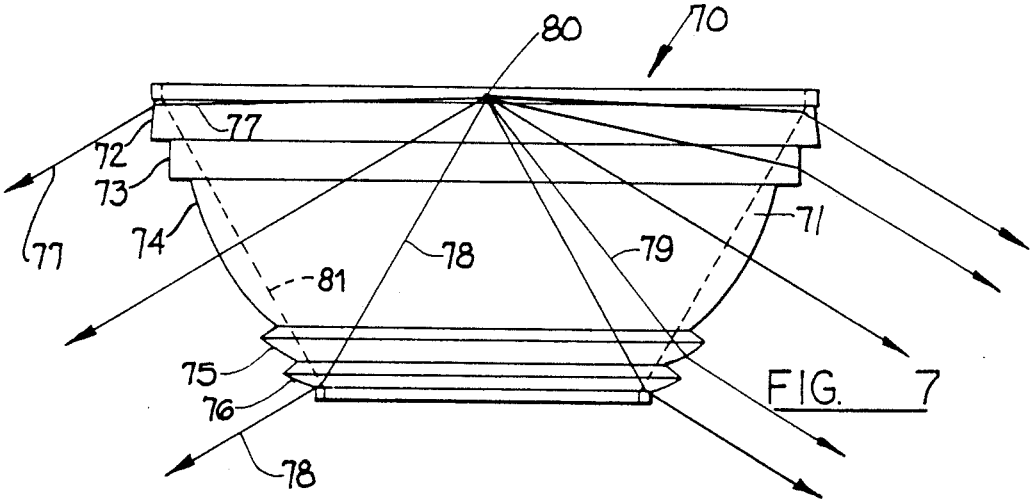
FIG. 7 is an elevational view of the toroidal lens system used in accordance with one embodiment of the present invention.

An example of the toroidal lens used in the toroidal optic system in accordance with the present invention is shown in FIGS. 7 and 8. FIG. 7 shows a conical Fresnel lens (generally indicated at 70) having cross-sectional face 71 (also shown in FIG. 8). The lens contains several refractive faces 72, 73, 74, 75 and 76 which cooperate to render light rays (such as 77, 78 and 79) substantially columnar subsequent to emanating from light source 80. The Fresnel lens of the present invention was designed using standard meridional ray trace equations which can be found in a number of textbooks including O'Shea, D., *Elements of Modern Optical Design*, Wylie &

Sons, New York (1985), which is hereby incorporated herein by reference. Preferably, the toroidal lens would be one that would provide an evenly diverging fan of rays to illuminate all of the prisms. Due to the spherical aberration in the lens and the fact that one of the surfaces was to be flat (i.e., surface 81) the segments of each of the sections corresponding to faces 72–76 were designed to approximate the ideal divergence by "stitching" the separate sections. At the center of the lens, the rays were found to diverge slightly more than required, and at the edge of the lens, the rays were found not to diverge quite enough. One way to compensate for this design result (i.e., the fact that the angle of incidence of the various rays varied from prism to prism) was done by adjusting the entrance face angle of the prism surfaces (such as angles 41*a* and 42*a* of prism faces 43 and 44, respectively, vis-a-vis, light rays 47 and 48, respectively) so as to deliver the ray through the center of the face to the back surface of the prisms (i.e., surfaces 45 and 46, respectively) at the same angle (i.e., angle 45*a* and 46*a*, being equal). Because all of the prism angles between the base of the prism array (i.e., surface 49) and the individual prism reflecting surfaces (i.e., 45 and 46) were set at the same angle, such arrangement assured that the central ray in each bundle of rays emerging from the bottom of the prism arrays was parallel to the neighboring central rays (i.e., rays 47*a* and 48*a*, being parallel).

The conical Fresnel lens 70 of the present invention offers a number of advantages. The lens 70 can be molded of plastic with a relatively thin wall. As a consequence, the lens 70 is light weight and less expensive to manufacture. With respect to the light from the light source, the conical Fresnel lens 70 is excellent for capturing as much as possible of the solid angle and directing it toward the prisms of planar prism field 10. The lens 70 can be made with a relatively large internal diameter so that it can be further spaced from the light source, enabling the use of a plastic lens. The larger internal diameter also enables the location of means to filter infrared within the lens 70.

The light source used in accordance with the present invention may be any appropriate light source having single or multiple filaments and of various appropriate intensities. It is preferred that appropriate changes to the toroidal lens system be made in order to properly account for light sources which use multiple filaments. This may be done, for instance, by using more than one toroidal lens in order to properly distribute the light to the planar prism field. In the case of multiple filaments, stacked toroidal lenses may be used to properly capture and columnate the light from each filament, and redistribute such light onto the prism field.

Another aspect of the present invention is the provision of a transparent plate or film between the prism field and the area to be illuminated. The position of such a plate or film can be seen in FIGS. 3 and 4 as Item 55 (see also FIG. 9). The plate or film 55 may be made of any suitable transparent material, preferably optical grade, such as the glasses or plexiglass known in the art.

The plate or film 55 protects the planar prism field 10 from dust, other foreign material and scratches. Since the prism sectors are joined together with a tongue and groove arrangement which can be supplemented with mechanical support means or adhesives, the plate or film 55 is not needed to support them. As a result the plate or film 55 can be removed for replacement or cleaning without disassembling the planar prism field 10. Furthermore, during the lamp assembly process the quality of the optical system can be checked. This normally requires full assembly of the lamp before such a check can be made. Finally, the plate or film 55 can also serve as a color corrector. To this end it is advantageous that the plate or film 55 does not have to serve as a support for the planar prism field 10 and therefore can be made thinner than would be required if it also served as a support.

Figure 9:
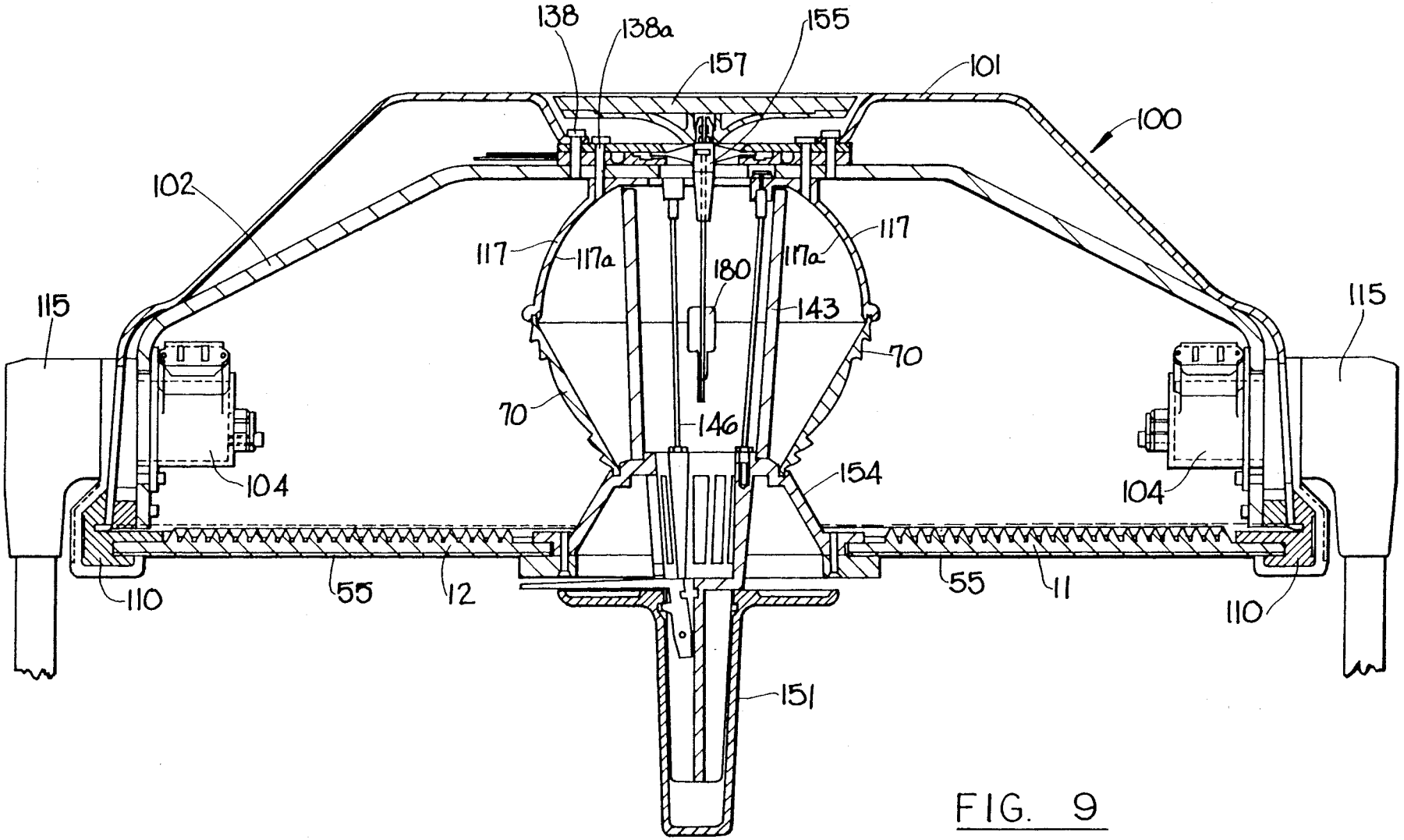
FIG. 9 is a cross-sectional elevational view of an assembled lamp in accordance with one embodiment of the present invention.

FIG. 9 shows a cross-sectioned, elevational view of a lamp 100 made in accordance with the present invention. FIG. 9 shows the position of planar prism field 10 and protective plate or film 55. The upper portion is protected by cupola 101 and is supported by internal structural support member 102. The assembly is held in place by tension cable assembly 146 and may be pivoted about pivot ends 115 on commutators 104. The handle 154 supports Fresnel lens 70 as well as the inner portion of the planar prism field 10. The light source 180 is provided with an infrared shield 143 to protect Fresnel lens 70. The light source 180 is held in place by bulb holder assembly 155. Bolts 138 and 138*a* hold the cupola 101, internal structural support 102 and Fresnel lens support 117 in position as shown in FIG. 9 Fresnel lens support 117 contains spherically concave reflective surface 117*a* which redirects light diverging above the light source 180 onto Fresnel lens 70. The lamp 100 may be positioned by and with the aid of sterile handle cover 151 or by a circumferential handle (not shown) about the circumference of the planar prism field 10. The outer edge of the planar prism field 10 is held in position by outer support 110 in cooperation with handle 154. The protective plate or film 55 may also be held in position by the cooperation of outer support member 110 and handle 154 as can be appreciated from FIG. 9.

Figure 10:
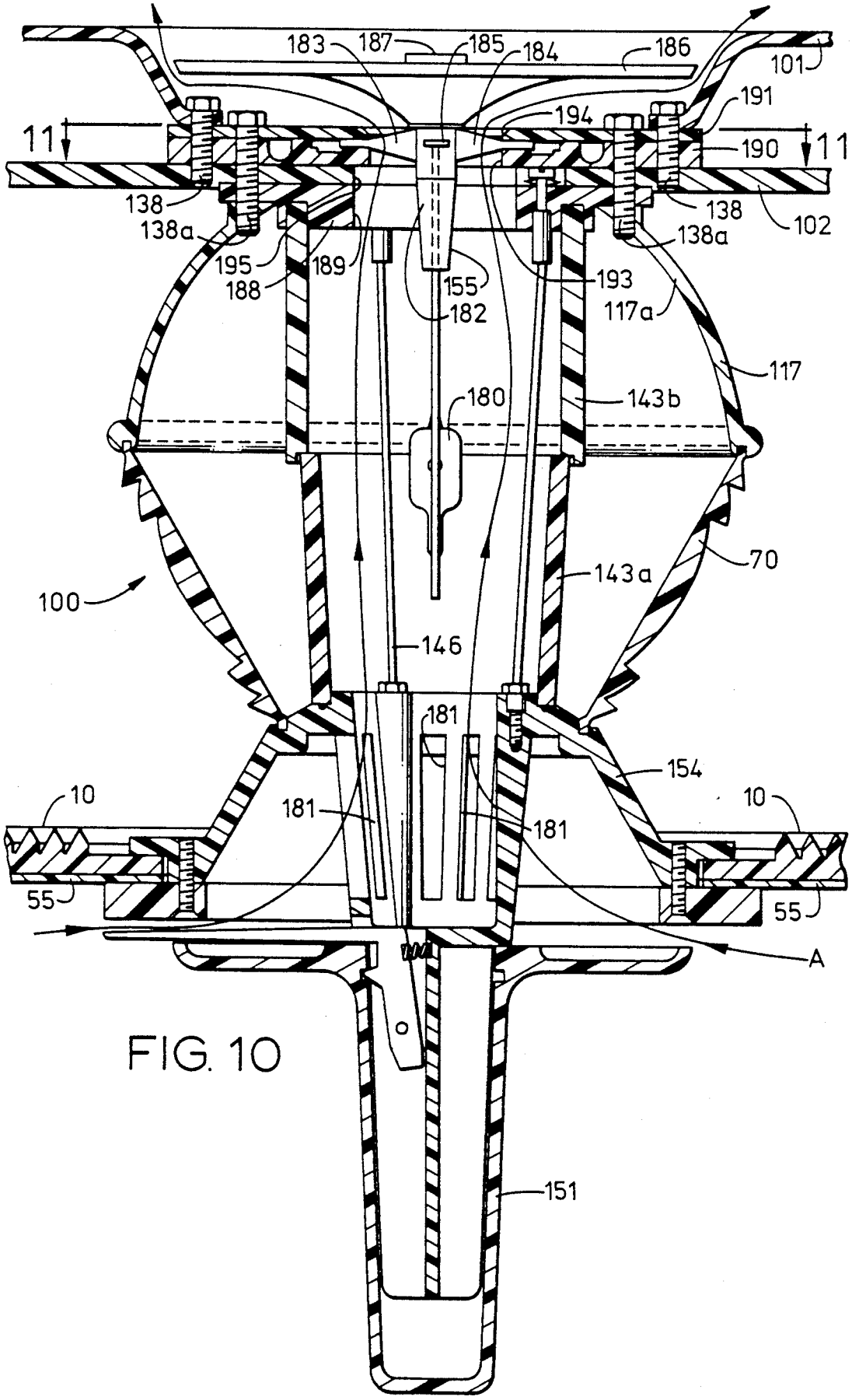
FIG. 10 is an enlarged, fragmentary, cross sectional view of the lamp head assembly of FIG. 9.

Reference is made to FIG. 10 which is a fragmentary enlargement of the central portion of FIG. 9. In FIG. 10, like parts have been given like index numerals.

FIG. 10 differs from FIG. 9 in only one respect. It will be noted in FIG. 9 that the lamp assembly is provided with an infrared shield or filter 143 constituting an integral one-piece member of treated glass. It will be apparent that rays from light source 80 above the juncture of Fresnel lens 70 and support 117 will pass through the filter 143 to reflective surface 117*a*. From the reflective surface, the rays will pass through diametrically opposite portions of the filter 143 on their path to Fresnel lens 70. Thus, these rays pass through filter 143 three times.

In FIG. 10, the filter is made up of two parts 143*a* and 143*b*. The lower portion of the filter 143*a* constitutes a glass member treated to serve as an infrared filter. The upper portion 143*b* of the filter constitutes plain, untreated glass. It will be apparent from FIG. 10 that the upper rays from light source 180 will pass through the untreated filter portion 143*b* twice and through the treated filter 143*a* only once. By virtue of this arrangement, the intensity of the light is increased.

It will be noted from FIG. 10 that the upper central portion of handle 154 is provided with a plurality of slots 181. When the sterile handle cover 151 is mounted in place and removably latched therein by latch member 182, there is a space between the lamp assembly bottom and the sterile handle cover 151. As a result of this, air can pass through the annular space between the bottom of the lamp assembly and the removable handle cover 151, through the slots 181 in handle 154, about light source 180 within the infrared filter 143*a*/143*b* and out the top of the lamp assembly about the bulb holder assembly 155. This flow of air is illustrated by the arrows A in FIG. 10. This flow of air cools the lamp 180 and is augmented by a chimney effect provided by the infrared filter 143*a*/143*b*.

The bulb 180 is supported by bulb holder assembly 155. The bulb holder assembly 155 has a body portion 182 of insulative material. The body portion 182, in turn, is provided with a pair of laterally extending, oppositely directed, stabilizing arms 183 and 184. The body portion 182 is also provided with a pair of laterally extending, oppositely directed contacts, one of which is indicated at 185. The contacts are oriented at 90° with respect to the stabilizing arms 183 and 184.

The insulative body portion 155 is surmounted by a disc-like, insulative top portion 186. The top portion 186 has an upstanding portion 187 inset therein and serving as a handle means by which the bulb holder assembly may be manipulated.

It will be noted from FIG. 10 that the structural support member 102 has an annular insulative element 188 affixed to its underside by bolts 138*a*. Element 188 has a central opening 189. The element 188 helps to support the upper end of filter portion 143*b* and the upper end of Fresnel lens support 117.

The structural support member 102 is surmounted by a pair of insulative annular ring-like members 190 and 191 each having a central opening 193 and 194, respectively. The internal structural support member 102, itself, has an opening 195 formed therein. It will be noted that the openings 189, 193, 194, and 195 are coaxial.

Figure 11:
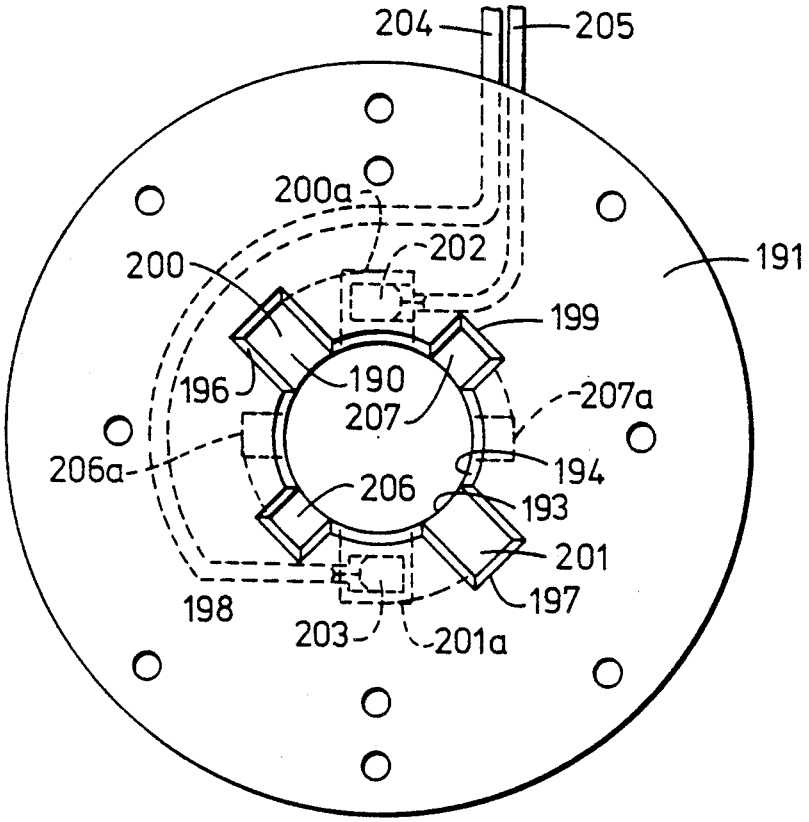
FIG. 11 is a fragmentary plan view of the center portion of the top of the lamp head assembly of the present invention, with the bulb holder assembly removed, and taken along line 12—12 of FIG. 11.

FIG. 11 is a plan view of the annular ring-like elements 190 and 191. The annular ring 190 has a pair of diametrically opposed slots 196 and 197 extending radially from opening 194, and a second pair of slots 198 and 199 which are diametrically opposed and extend radially from opening 194. The slots 198 and 199 are oriented at 90° with respect to the slots 196 and 197.

The disc-like member 190 has a pair of grooves 100 and 101 which underlie and correspond to the slots 196 and 197, respectively. The grooves 100 and 101 have extended portions 100*a* and 101*a* which underlie the annular disc-like member 191 and are provided with spring loaded electrical contacts 102 and 103, respectively. The contacts 102 and 103 are provided with appropriate electrical leads 104 and 105, respectively, mounted in grooves in the annular disc-like member 190.

Disc-like member 190 also has a pair of grooves 206 and 207 which correspond to slots 198 and 199, respectively. The grooves 206 and 207 have extended portions 206*a* and 207*a*.

The above-described arrangement enables the bulb holder assembly 155 to be firmly mounted in the lamp 100. To this end, the bulb holder assembly contacts (one of which is shown as 185 in FIG. 10) are inserted in grooves 200 and 201. Similarly, the stabilizing arms 183 and 184 are located in grooves 206 and 207. Once this has been done, the bulb holder assembly 155 is rotated a partial turn in the clockwise direction. This will cause the bulb holder contacts to engage spring loaded contacts 202 and 203 and the stabilizing arms 183 and 184 to shift to the ends of groove extensions 206*a* and 207*a*, respectively, firmly mounting the bulb holder assembly 155 and the bulb 180. To remove the bulb holder 155 and the bulb 180 from the lamp assembly, it is only necessary to rotate the bulb holder assembly 155 counterclockwise until the bulb holder contacts and stabilizing arms align with their respective ones of slots 196–198, whereupon the bulb holder assembly 155 and bulb 180 can be lifted and removed from the lamp assembly.

Preferably, the bulb holder assembly 155, together with its bulb 180, is made as a disposable assembly. As a result of this, the bulb need never be touched. There will not be a problem of degrading of the bulb holder assembly 155. Finally, the bulb 180 and the bulb holder assembly 155 can be easily and quickly changed in the field, should the bulb fail.

Modifications can be made in the invention without departing from the spirit of it. For example, while a preferred type of prism sector has been described, the schedule of curvature of the prisms enables the designer to engineer a specific pattern for a prism array depending on the surface being illuminated.

The inside surface 81 of Fresnel lens 70 could be curved. The shape of surface 81 can be used to adjust the overall divergence of the Fresnel lens.

Different areas of the body require different illumination. It would be within the scope of the invention to provide the lamp with a series of transparent plates 55, each with different color correction characteristics.

What is claimed is:

1. In a lamp providing uniform luminosity in an area to be illuminated, such as an operating theatre and the like, and comprising a light source, a planar circular prism field, said planar circular prism field having a substantial number of radial sectors containing a plurality of transverse, outwardly curved prisms, the curvature of said prisms of said sectors varying such that the curvature of the prisms toward the center of said planar circular prism field is greater than the curvature of those prisms toward the periphery of said planar circular prism field, said radial sectors of said planar circular prism field being held together by attachment to one another, a toroidal lens system rendering the light emanating from said light source substantially columnar and directing said light onto said planar circular prism field, the improvement comprising a conical Fresnel lens, molded of plastic, and constituting the lens portion of said toroidal lens system.

2. The lamp claimed in claim 1 including a substantially cylindrical infrared radiation filter located about said light source and within said Fresnel lens.

3. The lamp claimed in claim 2 wherein said infrared radiation filter comprises lower and upper substantially cylindrical elements. Said lower element comprising glass treated for the filtering of infrared radiation, said upper portion comprising plain glass, whereby all of the rays passing to said Fresnel lens are filtered only once.

4. The lamp claimed in claim 1 including a transparent plate mounted directly beneath the planar circular prism field to protect said prism field from dust, foreign material and scratches, said plate being removable for cleaning and replacement without disturbing the sectors of said planar circular prism field.

5. The lamp claimed in claim 1 including a handle assembly depending downwardly from said lamp and located centrally of said planar circular prism field, said handle having a plurality of slots therein permitting air to circulate about said light source to cool said light source.

6. The lamp claimed in claim 3 including a handle assembly depending downwardly from said lamp and located centrally of said planar circular prism field, said handle assembly having a plurality of slots therein permitting air to circulate through said infrared filter element and about said light source, said air exiting said lamp at the top thereof, whereby to cool said light source.

7. The lamp claimed in claim 1 wherein said light source comprises a bulb, a bulb holder assembly supporting said bulb, said bulb holder being attachable and detachable with respect to said lamp, said bulb holder having contacts matable with contacts in said lamp to supply power to said bulb, said bulb holder and said bulb being disposable when said bulb fails.

* * * * *